US009061516B2

(12) United States Patent
Akiyama et al.

(10) Patent No.: US 9,061,516 B2
(45) Date of Patent: Jun. 23, 2015

(54) INKJET PRINTER

(71) Applicant: RISO KAGAKU CORPORATION, Tokyo (JP)

(72) Inventors: Tomoyuki Akiyama, Ibaraki (JP); Hiroshi Sugitani, Ibaraki (JP); Akira Nishiyama, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/484,550

(22) Filed: Sep. 12, 2014

(65) Prior Publication Data

US 2015/0091956 A1 Apr. 2, 2015

(30) Foreign Application Priority Data

Sep. 30, 2013 (JP) ..... 2013-203313

(51) Int. Cl.

| | |
|---|---|
| ***B41J 29/38*** | (2006.01) |
| ***B41J 29/393*** | (2006.01) |
| ***B41J 2/17*** | (2006.01) |
| ***B41J 2/175*** | (2006.01) |

(52) U.S. Cl.

CPC ..... *B41J 2/17596* (2013.01)

(58) Field of Classification Search

USPC ..... 347/6, 19, 84–86

See application file for complete search history.

(56) References Cited

U.S. PATENT DOCUMENTS

2010/0177148 A1* 7/2010 Asami ..... 347/85
2010/0194798 A1* 8/2010 Asami et al. ..... 347/7

FOREIGN PATENT DOCUMENTS

JP 2009-297961 A 12/2009

* cited by examiner

*Primary Examiner* — Jason Uhlenhake

(74) *Attorney, Agent, or Firm* — Greenblum & Bernstein P.L.C.

(57) ABSTRACT

A first ink air chamber is in communication with an air layer in a first ink tank for an ink of a first viscosity in communication with a first inkjet head. A second ink air chamber is in communication with an air layer in a second ink tank for an ink of a second viscosity in communication with a second inkjet head. A first on-off valve opens or closes communication between the first and second ink air chambers. A second on-off valve opens or closes communication between the second ink air chamber and the atmosphere. A pressure adjuster is configured to adjust a pressure in the second ink air chamber without intervention of the first ink air chamber. A controller is configured to drive the pressure adjuster to increase the pressure in the second ink air chamber with the first and second on-off valves being closed.

4 Claims, 8 Drawing Sheets

INKJET PRINTER

CROSS REFERENCE TO RELATED APPLICATION

This application is based upon and claims the benefit of priority from the prior Japanese Patent Application No. 2013-203313, filed on Sep. 30, 2013, the entire contents of which are incorporated herein by reference.

BACKGROUND

1. Technical Field

The disclosure relates to an inkjet printer configured to perform an efficient purge operation using a predetermined ink with a simple device configuration.

2. Related Art

An inkjet printer is capable of printing images, characters and the like by ejecting ink onto print paper from nozzles in an inkjet head based on print data. Also, the inkjet printer uses multicolor inks to perform color printing of print data on print paper.

The inks used in such an inkjet printer have temperature characteristics such that the viscosity changes with temperature conditions, i.e., the viscosity is high at low temperature and is low at high temperature. Particularly, when the ink viscosity is high, a variation may occur in droplet size or ejection speed of ink droplets, leading to a situation where a high-definition printed matter cannot be obtained.

In this regard, an ink circulation type inkjet printer has been generally well-known, which warms ink with warm water or the like while circulating the ink.

Japanese Patent Application Publication No. 2009-297961 proposes a technique related to an image recording device in which an ink circulation path is formed by an inkjet head configured to eject ink from nozzles, a first tank configured to store ink to be fed to the inkjet head and disposed at a position higher than that of the inkjet head in a vertical direction, a second tank configured to store ink that remains unejected from the inkjet head, and a pump configured to circulate the ink among the first tank, the inkjet head and the second tank. In the image recording device, a pressure adjuster to adjust the pressure in the ink circulation path is provided communicating with the second tank, and the pressure adjuster sets the pressure in the second tank to a negative pressure, thereby circulating the ink.

SUMMARY

Moreover, for the purpose of preventing nozzle clogging by removing waste such as dried ink on the surface of the inkjet head, the inkjet printer periodically performs processing of forcibly discharging or suctioning the ink from the inkjet head (hereinafter referred to as a purge operation).

In this connection, it is conceivable that the ink circulation type inkjet printer configured to circulate ink performs the purge operation by adjusting the pressure in the circulation path.

Meanwhile, since the inks used in the inkjet printer are different in viscosity depending on the colors of the inks, it is desirable to perform the purge operation with a predetermined ink among the multiple inks in some cases.

In such a case, in the image recording device described in Japanese Patent Application Publication No. 2009-297961, it is difficult to individually adjust the pressure of a certain ink since the pressure adjuster sets the pressure in the second tank to the negative pressure and thus the same negative pressure is set for all the inks.

Moreover, a device configuration including the pressure adjusters for respective ink colors is complicated, leading to an increase in manufacturing costs.

It is an object of the present invention to provide an inkjet printer capable of performing an efficient purge operation using a predetermined ink with a simple device configuration.

An inkjet printer in accordance with some embodiments includes: a first inkjet head configured to eject an ink having a first viscosity onto a print medium; a second inkjet head configured to eject an ink having a second viscosity different from the first viscosity onto the print medium; a first ink tank in communication with the first inkjet head and configured to store the ink having the first viscosity; a second ink tank in communication with the second inkjet head and configured to store the ink having the second viscosity; a first ink air chamber in communication with an air layer in the first ink tank; a second ink air chamber in communication with an air layer in the second ink tank; a communicating pipe through which the first ink air chamber and the second ink air chamber communicate with each other; a first on-off valve provided in the communicating pipe and configured to open or close communication between the first ink air chamber and the second ink air chamber; an atmosphere open pipe connected to the second ink air chamber and opened to the atmosphere; a second on-off valve provided in the atmosphere open pipe and configured to open or close communication between the second ink air chamber and the atmosphere; a pressure adjuster configured to adjust a pressure in the second ink air chamber without intervention of the first ink air chamber; and a controller configured to control the first on-off valve, the second on-off valve, and the pressure adjuster, and configured to drive the pressure adjuster to increase the pressure in the second ink air chamber with the first on-off valve and the second on-off valve being closed.

According to the above configuration, the controller controls the pressure adjuster to increase the pressure in the second ink air chamber in the state where the first on-off valve and the second on-off valve are closed. Thus, the pressure in the second ink tank connected to the second ink air chamber can be increased. As a result, the purge operation can be selectively performed for the second inkjet head connected to the second ink tank. Accordingly, an efficient purge operation can be performed using a predetermined ink with a simple device configuration.

The inkjet printer may further include a viscosity information acquisition unit configured to acquire viscosity information of the first viscosity and the second viscosity. The controller may be configured to drive the pressure adjuster to increase a pressure in the first ink air chamber and the pressure in the second ink air chamber to a first pressure required for a purge operation of the first inkjet head with the first on-off valve being opened and the second on-off valve being closed, and then control opening and closing of the first and second on-off valves such that purge operations of the first and second inkjet heads are performed based on the viscosity information acquired by the viscosity information acquisition unit.

According to the above configuration, the pressures in the first and second ink air chambers can be adjusted according to the ink viscosity. Thus, the purge operation can be performed by discharging an appropriate amount of ink from the first and second inkjet heads.

The inkjet printer may further include a viscosity information acquisition unit configured to acquire viscosity information of the first viscosity and the second viscosity. When the controller determines based on the viscosity information acquired by the viscosity information acquisition unit that the second viscosity is higher than the first viscosity, the controller may be configured to drive the pressure adjuster to increase a pressure in the first ink air chamber and the pressure in the second ink air chamber to a first pressure required for a purge operation of the first inkjet head with the first on-off valve being opened and the second on-off valve being closed, and then drive the first on-off valve to close and drive the pressure adjuster to increase the pressure in the second ink air chamber to a second pressure higher than the first pressure.

According to the above configuration, the pressures in the second ink air chamber corresponding to the ink having high viscosity can be set higher than the pressure in the first ink air chamber corresponding to the ink having low viscosity. Thus, the purge operation can be performed by discharging the same amount of ink regardless of the ink viscosity.

The inkjet printer may further include a viscosity information acquisition unit configured to acquire viscosity information of the first viscosity and the second viscosity. When the controller determines based on the viscosity information acquired by the viscosity information acquisition unit that the first viscosity is higher than the second viscosity, the controller may be configured to drive the pressure adjuster to increase a pressure in the first ink air chamber and the pressure in the second ink air chamber to a first pressure required for a purge operation of the first inkjet head with the first on-off valve being opened and the second on-off valve being closed, and then drive the first on-off valve to close, drive the second on-off valve to open upon elapse of a first time after the pressures reach the first pressure, and drive the first on-off valve to open upon elapse of a second time longer than the first time after the pressures reach the first pressure.

According to the above configuration, the time for which the second ink air chamber corresponding to the ink having high viscosity is maintained at a constant pressure can be set longer than the time for which the first ink air chamber corresponding to the ink having low viscosity is maintained at a constant pressure. Thus, the purge operation can be performed by discharging the same amount of ink regardless of the ink viscosity.

DETAILED DESCRIPTION

Figure 1:
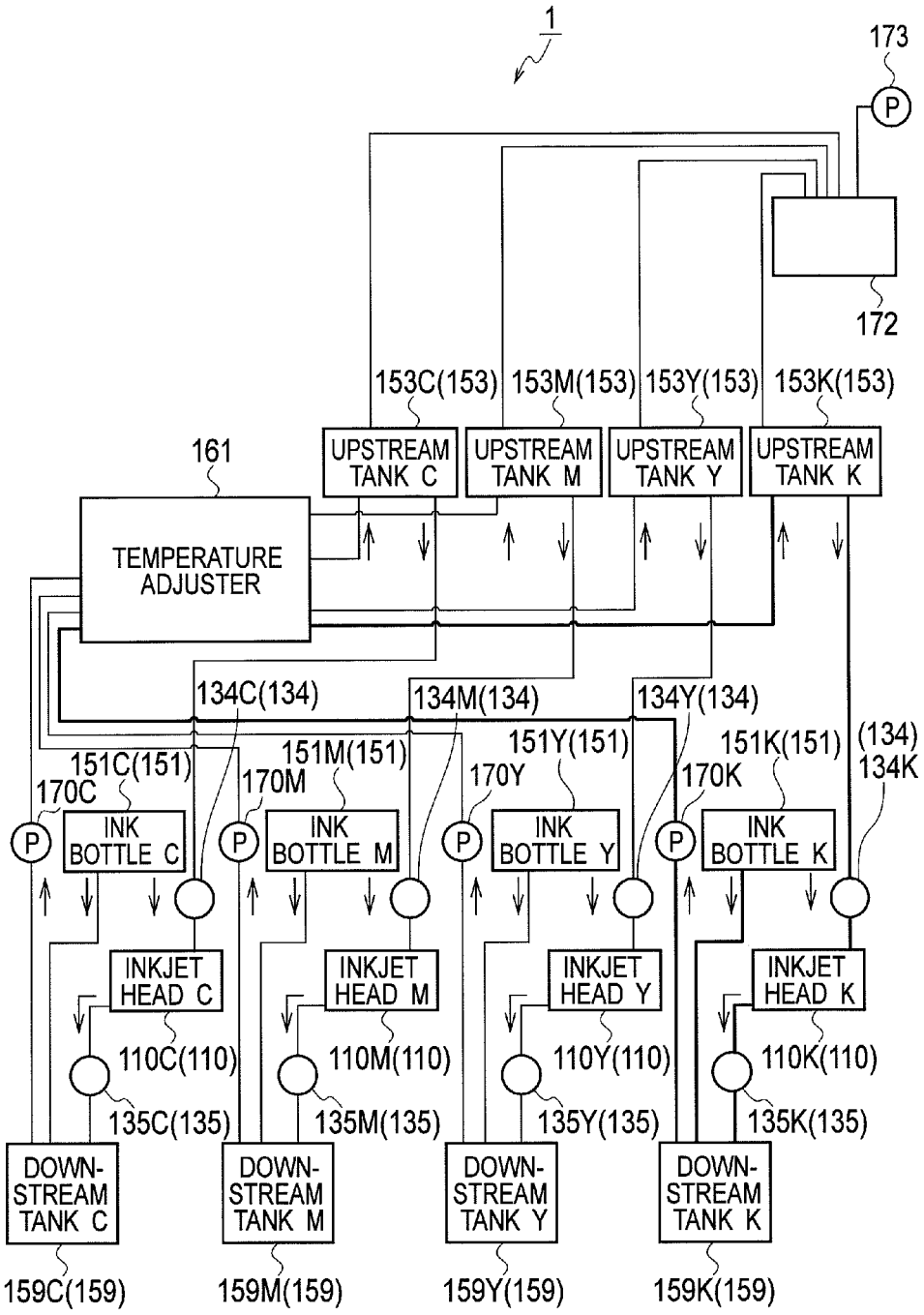
FIG. 1 is a diagram showing a configuration of an inkjet printer according to Embodiment 1 of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

In Embodiment 1 of the present invention, description is given by taking as an example an inkjet printer, which is an ink circulation type inkjet printer configured to circulate ink ejected from inkjet heads, and is configured to perform a purge operation of a predetermined inkjet head.

FIG. 1 is a diagram showing a configuration of an inkjet printer 1 according to Embodiment 1 of the present invention.

As shown in FIG. 1, the inkjet printer 1 includes inkjet heads 110C, 110M, 110Y and 110K corresponding to C (cyan), M (magenta), Y (yellow) and K (black) inks. Print paper is printed line by line with the inks ejected from the inkjet heads 110C, 110M, 110Y and 110K while being transferred at a speed specified by printing conditions by a looped transfer belt (not shown) provided facing the inkjet heads 110C, 110M, 110Y and 110K.

The respective inks are supplied from detachable ink bottles. The inkjet printer 1 includes an ink bottle 151C to supply the C (cyan) ink, an ink bottle 151M to supply the M (magenta) ink, an ink bottle 151Y to supply the Y (yellow) ink, and an ink bottle 151K to supply the K (black) ink. Note that, in the following description, the ink bottles are collectively referred to as the ink bottles 151 if it does not matter which ink color is referred to. The same goes for the other functional units.

The inks supplied from the ink bottles 151 are temporarily stored in downstream tanks (ink tanks) 159 provided on the downstream side of the inkjet heads 110 after passing through ink circulation paths formed of pipes made of resin, metal and the like. Therefore, the inkjet printer 1 includes, as the downstream tanks 159, a downstream tank 159C to store the C (cyan) ink, a downstream tank 159M to store the M (magenta) ink, a downstream tank 159Y to store the Y (yellow) ink, and a downstream tank 159K to store the K (black) ink.

The inks stored in the downstream tanks 159 are sent by pumps to upstream tanks provided on the upstream side of the inkjet heads 110. Therefore, the inkjet printer 1 includes pumps 170C, 170M, 170Y and 170K and upstream tanks 153C, 153M, 153Y and 153K. The inks sent to the upstream tanks 153 are then sent to the inkjet heads 110 having a number of nozzles to eject the inks.

The inks not ejected from the inkjet heads 110 are returned to the downstream tanks 159. A head differential between the upstream tanks 153 and the downstream tanks 159 is used for the return of the inks to the downstream tanks 159 from the upstream tanks 153 through the inkjet heads 110.

A common air chamber 172 is connected to the upstream tanks 153, and a pump 173 provided in the common air chamber 172 sends air to the upstream tanks 153.

For the inks, a temperature range that guarantees print quality is specified. When the ambient temperature is low and the ink temperature is below a lower limit temperature that allows printing, it is required to heat the inks. Meanwhile, drivers and piezoelectric elements provided in the inkjet heads 110 generate heat during operation. Thus, it is required to suppress an influence and the like of an increase in ink temperature at high temperature due to such heat or Joule heat caused by ink vibration. Therefore, a temperature adjuster 161 is provided on the ink circulation path, and the inks are heated or cooled by the temperature adjuster 161.

Moreover, viscometers 134 (134C, 134M, 134Y and 134K) are provided, for the respective inkjet heads 110, to measure the viscosity of each of the inks flowing into each of the inkjet heads 110 from each of the upstream tanks 153 and to supply a controller 10 to be described later with the measured ink viscosity at a predetermined time interval.

Furthermore, thermometers 135 (135C, 135M, 135Y and 135K) are provided, for the respective inkjet heads 110, to measure the temperature of each of the inks flowing out to each of the downstream tanks 159 from each of the inkjet heads 110 and to supply the controller 10 to be described later with the measured ink temperature as viscosity information at a predetermined time interval.

Next, detailed description is given of the ink circulation paths through which the inks ejected from the nozzles in the inkjet heads are circulated.

Figure 2:
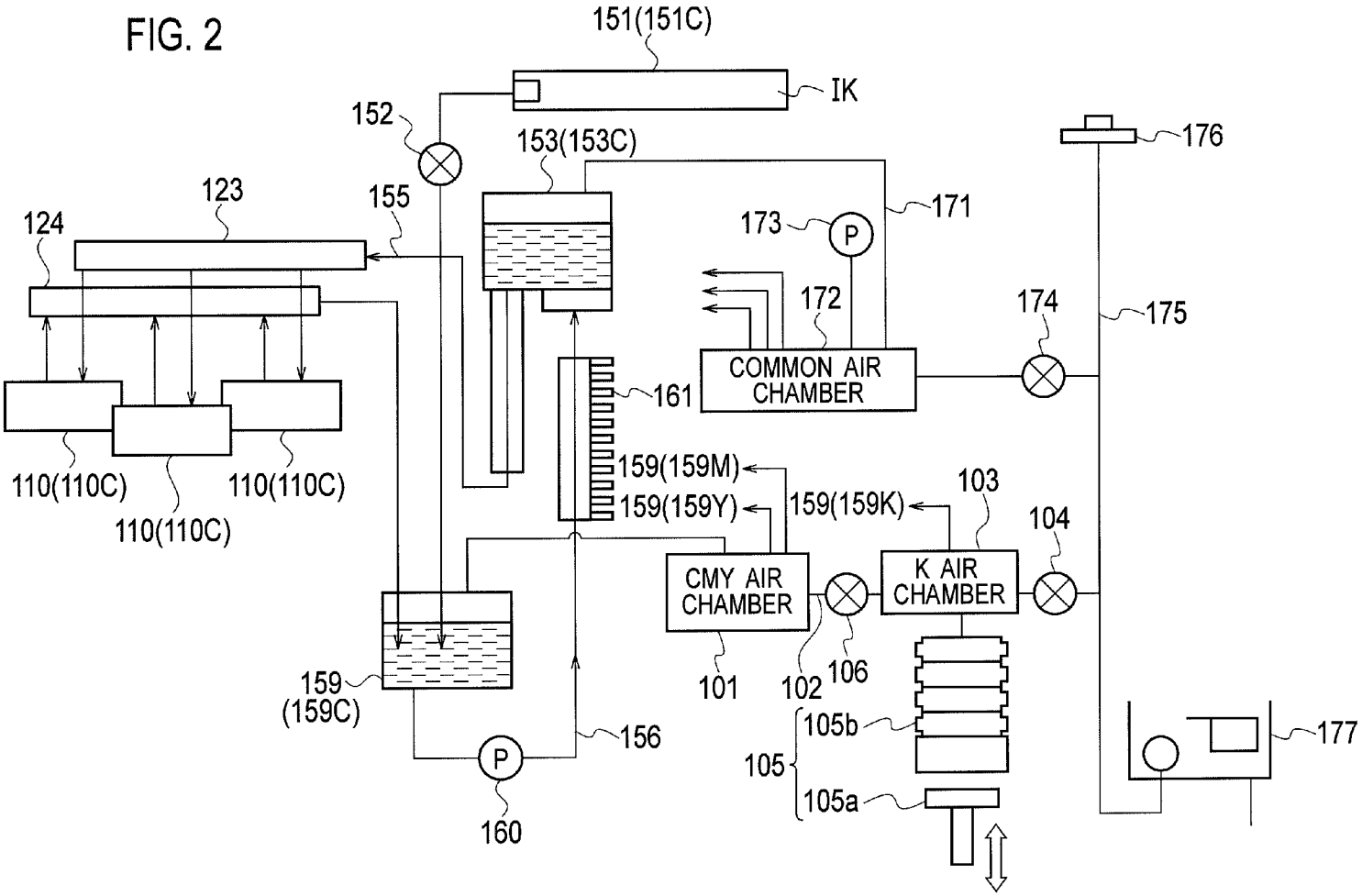
FIG. 2 is a diagram schematically showing circulation paths through which inks ejected from nozzles in inkjet heads are circulated in the inkjet printer according to Embodiment 1 of the present invention.

FIG. 2 is a diagram schematically showing the ink circulation paths through which the inks ejected from the nozzles in the inkjet heads are circulated in the inkjet printer 1 according to Embodiment 1. Note that although description is given here of only the ink circulation path for the C (cyan) ink, the ink circulation paths for M (magenta), Y (yellow) and K (black) also have the same configuration.

As shown in FIG. 2, the inkjet printer 1 according to Embodiment 1 includes the upstream tank 153 storing ink IK, as described above. The upstream tank 153 is connected through an ink feed path 155 to an ink feed chamber 123 provided on the upstream side of the inkjet head 110 to eject ink.

Furthermore, an ink recovery chamber 124 provided on the downstream side of the inkjet head 110, the downstream tank 159 to store the ink IK recovered from the ink recovery chamber 124, a pump 160, the temperature adjuster 161 and the upstream tank 153 are connected through an ink recovery path 156. Thus, the ink stored in the downstream tank 159 is sent toward the temperature adjuster 161 by activating the pump 160.

An air communication path 171 is connected to the upstream tank 153, and the common air chamber 172 is provided, which is connected to an air layer in the upper part of the upstream tank 153 through the air communication path 171.

An atmosphere open pipe 175 is connected to the common air chamber 172, and the atmosphere open pipe 175 includes an atmosphere open valve 174. The inside of the common air chamber 172 is opened to the atmosphere by opening the atmosphere open valve 174. The common air chamber 172 can also be hermetically closed by closing the atmosphere open valve 174. Furthermore, the common air chamber 172 is provided with a pump 173 configured to send air into the common air chamber 172.

Since the common air chamber 172 is provided with the atmosphere open valve 174 and the pump 173 as described above, the air pressure in the common air chamber 172 can be adjusted. Accordingly, the pressure of the air layer in the upper part of the upstream tank 153 communicating with the common air chamber 172 can be adjusted.

Moreover, the atmosphere open pipe 175 is provided with an air filter 176 which keeps dust in the air from entering into the atmosphere open pipe 175 and an overflow pan 177 in the lower part, which recovers ink overflowing from the downstream tank 159 and flowing into the atmosphere open pipe 175.

The downstream tank 159 is connected to the ink bottle 151 filled with the ink IK. Fresh ink IK stored in the ink bottle 151 is fed to the downstream tank 159 by opening an ink supply valve 152.

Note that, when the downstream tank 159 is maintained at an atmospheric pressure, a height position of the downstream tank 159 is determined so as to set a proper pressure at which a head differential between the downstream tanks 159 and the nozzles in the inkjet head 110 causes a meniscus in the nozzles.

Therefore, when the ink IK is circulated through an ink circulation path 157 including the ink feed path 155 and the ink recovery path 156, a head differential between the upstream tank 153 and the downstream tank 159 when the atmosphere open valve 174 provided in the common air chamber 172 is opened allows the ink IK stored in the upstream tank 153 to be fed into the ink feed chamber 123 in an inkjet head unit through the ink feed path 155. Then, the ink IK is distributed to the two-dimensionally-arranged inkjet heads 110 from the ink feed chamber 123, and the ink IK is selectively ejected onto the print paper from each of the inkjet heads 110.

Moreover, a CMY air chamber 101 is provided, which communicates with air layers in the downstream tanks 159C, 159M and 159Y, among the downstream tanks 159, which recover the C (cyan), M (magenta) and Y (yellow) inks lower in viscosity than the K (black) ink. Also, a K air chamber 103 is provided, which communicates with an air layer in the downstream tank 159K, among the downstream tanks 159, which recovers the K (black) ink having high viscosity.

The K air chamber 103 is provided with a pressure adjuster 105. A bellows main body unit 105*b* is expanded and contracted by lifting and lowering a bellows elevating mechanism 105*a*. Thus, the pressure in the K air chamber 103 can be adjusted. In this embodiment, the pressure adjuster 105 adjusts the pressure in the K air chamber 103 by a volume change in the bellows main body unit 105*b*, which is caused by expansion and contraction of the bellows main body unit 105*b*, the volume change directly acting on the air in the K air chamber 103.

The CMY air chamber 101 and the K air chamber 103 are communicating with each other by a communicating pipe 102. The pressures in the CMY air chamber 101 and the K air chamber 103 are set the same by opening a pressure seal valve 106 provided in the communicating pipe 102, while the CMY air chamber 101 and the K air chamber 103 are cut off by closing the pressure seal valve 106.

Moreover, the atmosphere open pipe 175 is connected to the K air chamber 103, and an atmosphere open valve 104 is provided in the atmosphere open pipe 175. The inside of the K air chamber 103 is opened to the atmosphere by opening the atmosphere open valve 104, while the inside of the K air chamber 103 is sealed by closing the atmosphere open valve 104.

Figure 3:
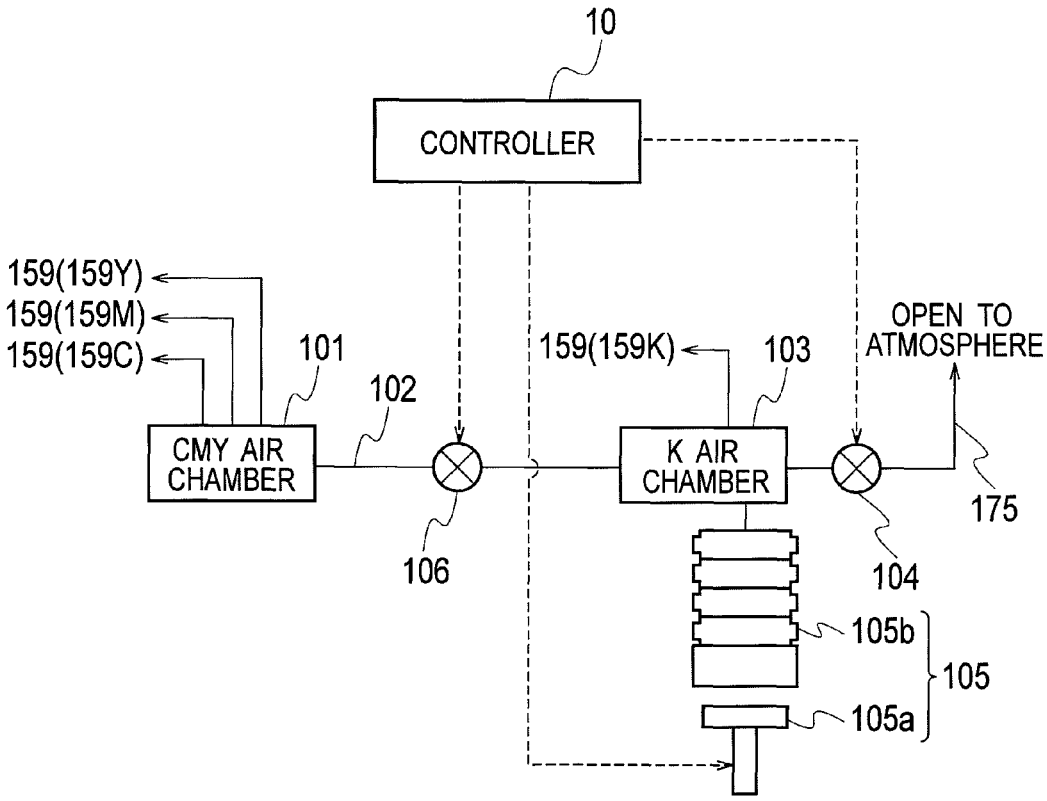
FIG. 3 is a functional block diagram showing a functional configuration of the inkjet printer according to Embodiment 1 of the present invention.

FIG. 3 is a functional block diagram showing a functional configuration of the inkjet printer 1 according to Embodiment 1.

Here, inks to be used in the inkjet printer 1 are different in viscosity depending on the color of the ink. To be more specific, among the C (cyan), M (magenta), Y (yellow) and K (black) inks, the C (cyan), M (magenta) and Y (yellow) inks are relatively low in viscosity and less prone to nozzle clogging. On the other hand, the K (black) ink is relatively high in viscosity and prone to nozzle clogging.

Therefore, in Embodiment 1, description is given by taking as an example the inkjet printer 1 configured to selectively perform a purge operation for the inkjet head 110K that ejects the K (black) ink relatively high in viscosity and prone to nozzle clogging.

As described above, the inkjet printer 1 includes: the CMY air chamber 101 communicating with the air layers in the downstream tanks 159C, 159M and 159Y; and the K air chamber 103 communicating with the air layer in the downstream tank 159K. Also, the pressure seal valve 106 is provided in the communicating pipe 102 that communicates the CMY air chamber 101 and the K air chamber 103 with each other. Moreover, the K air chamber 103 includes the pressure adjuster 105, and the atmosphere open valve 104 is provided in the atmosphere open pipe 175 connected to the K air chamber 103.

The controller 10 in the inkjet printer 1 according to Embodiment 1 controls central processing such as print processing in the inkjet printer 1, and is electrically connected to the atmosphere open valve 104, the pressure adjuster 105 and the pressure seal valve 106 as shown in FIG. 3 for control thereof.

To be more specific, the controller 10 controls a purge operation so as to allow the pressure adjuster 105 to increase the pressure in the K air chamber 103 in a state where the pressure seal valve 106 and the atmosphere open valve 104 are closed. Accordingly, the K air chamber 103 is cut off from the CMY air chamber 101 and the atmosphere, thereby increasing the pressure of the air layer in the downstream tank 159K communicating with the K air chamber 103.

Figure 4:
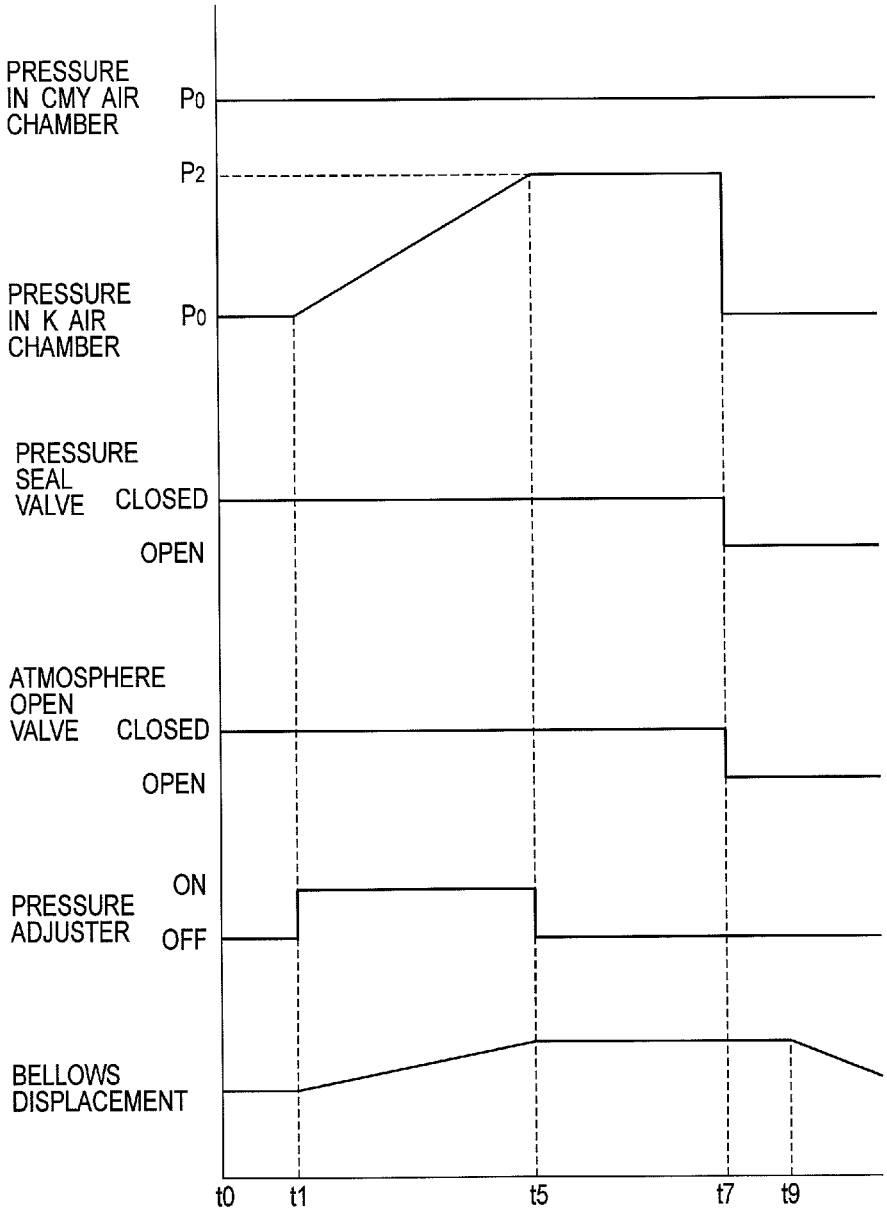
FIG. 4 is a timing chart showing a purge operation that is selectively performed by the inkjet printer according to Embodiment 1 of the present invention.

FIG. 4 is a timing chart showing a purge operation that is selectively performed by the inkjet printer 1 according to Embodiment 1.

As shown in FIG. 4, the pressure seal valve 106 and the atmosphere open valve 104 are in a closed state at point t0. Thus, the K air chamber 103 is in a state of being communicating with the downstream tank 159K, and is not affected by the CMY air chamber 101 or the atmospheric pressure.

Then, when the pressure adjuster 105 is turned on at point t1, the pressure adjuster 105 starts a purge operation so as to increase the pressure in the K air chamber 103. To be more specific, as displacement of the bellows elevating mechanism 105*a* increases, the bellows main body unit 105*b* is expanded and the pressure in the K air chamber 103 starts to rise from P0.

Accordingly, the pressure of the air layer in the downstream tank 159K communicating with the K air chamber 103 rises. When the pressure in the K air chamber 103 reaches P2 at point t5, the level of liquid is lowered by the pressure applied to the black (K) ink IK stored in the downstream tank 159K. Then, the ink IK is discharged from the nozzles in the inkjet head 110K into the ink recovery chamber 124 by the applied pressure. Thus, nozzle clogging can be prevented by removing waste such as dried ink on the surface of the inkjet head 110K. In this event, since the pressure seal valve 106 is closed, the pressure in the CMY air chamber 101 stays the same at P0 and thus no purge operation is performed.

Thereafter, when the pressure seal valve 106 and the atmosphere open valve 104 are opened at point t7, the pressures in the CMY air chamber 101 and the K air chamber 103 become the atmospheric pressure, and the purge operation is completed.

As described above, in the inkjet printer 1 according to Embodiment 1, the controller 10 controls the pressure adjuster 105 to increase the pressure in the K air chamber 103 in the state where the pressure seal valve 106 and the atmosphere open valve 104 are closed. Thus, the purge operation can be selectively performed for the inkjet head 110K that ejects the K (black) ink relatively high in viscosity and prone to nozzle clogging. Accordingly, the inkjet printer 1 can perform an efficient purge operation with a simple configuration.

Note that, in Embodiment 1, the description is given by taking as an example the inkjet printer 1 configured to selectively perform the purge operation by allowing the pressure adjuster 105 to increase the pressure in the K air chamber 103 in the state where the pressure seal valve 106 and the atmosphere open valve 104 are closed. However, the present invention is not limited thereto, but the inkjet printer may perform a purge operation corresponding to the ink viscosity measured by the viscometers 134 (134C, 134M, 134Y and 134K).

Figure 5A:
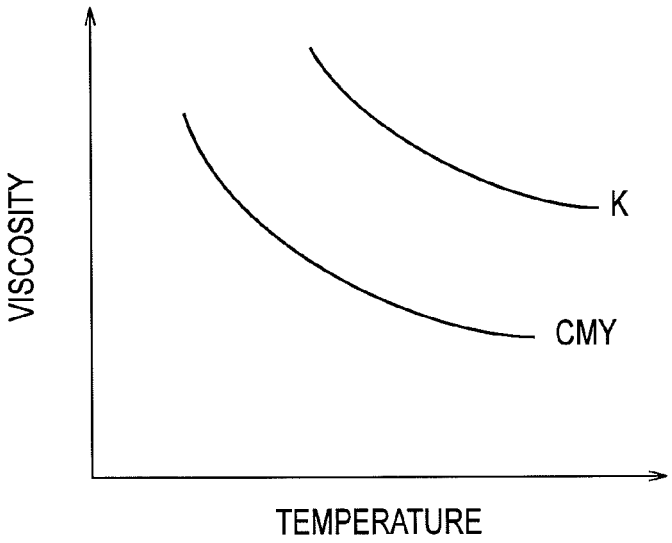
FIG. 5A is a graph showing a relationship between the temperature and viscosity of ink used in the inkjet printer according to Embodiment 1 of the present invention.
Figure 5B:
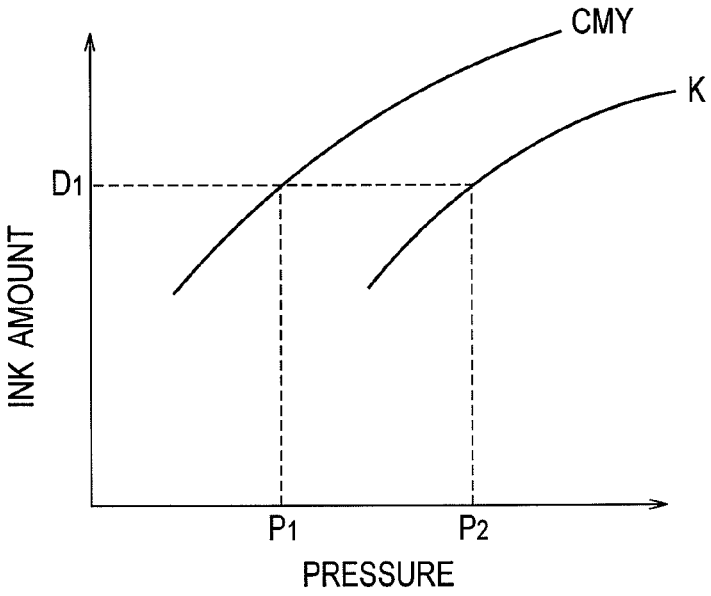
FIG. 5B is a graph showing a relationship between the amount of ink to be ejected and the pressure applied to the ink used in the inkjet printer according to Embodiment 1 of the present invention.

FIGS. 5A and 5B are graphs showing characteristics of the inks used in the inkjet printer 1. FIG. 5A is a graph showing a relationship between the temperature of the ink and the viscosity of the ink. FIG. 5B is a graph showing a relationship between the pressure applied to the ink and the amount of the ink to be ejected.

The inks used in the inkjet printer 1 have temperature characteristics that the viscosity changes with temperature conditions. The viscosity varies with the kind of ink, i.e., the color of ink, which is determined by the composition, physical properties, characteristics, the kind of solvent, the presence or absence of additives, or the like. To be more specific, as shown in FIG. 5A, the viscosity of the K (black) ink is always higher than those of the C (cyan), M (magenta) and Y (yellow) inks at any temperature.

For this reason, as shown in FIG. 5B, when a purge operation to forcibly discharge or suction the ink from the inkjet head 110, the amount of the ink to be discharged from the inkjet head 110 varies with the color of the ink. To be more specific, among the C (cyan) M (magenta), Y (yellow) and K (black) inks, the C (cyan), M (magenta) and Y (yellow) inks are relatively low in viscosity, and the K (black) ink is relatively high in viscosity. Therefore, when it is tried to discharge all the C (cyan), M (magenta), Y (yellow) and K (black) inks by an ink amount D1, the pressure in the downstream tank 159 need only be increased to the pressure P1 for the C (cyan), M (magenta) and Y (yellow) inks, while the pressure in the downstream tank 159 needs to be increased to the pressure P2 for the K (black) that is higher than the pressure P1.

Therefore, in Embodiment 1, the controller 10 allows the pressure adjuster 105 to increase the pressures in the CMY air chamber 101 and the K air chamber 103 to the pressure P1 in the state where the pressure seal valve 106 is opened and the atmosphere open valve 104 is closed, and then controls the pressure adjuster 105 to increase the pressure in the K air chamber 103 to the pressure P2 higher than the pressure P1 by closing the pressure seal valve 106 based on the ink viscosity (viscosity information) measured by the viscometers (viscosity information acquisition unit) 134 (134C, 134M, 134Y and 134K). Specifically, the pressures P1 and P2 are determined based on the ink viscosity measured by the viscometers 134 (134C, 134M, 134Y and 134K) as the pressure to discharge the ink by the ink amount D1. Thus, the ink can be discharged by the ink amount D1 regardless of the ink viscosity. Note that the controller 10 may perform the above control only when it is determined, based on the ink viscosities (viscosity information) measured by the viscometers (viscosity information acquisition unit) 134 (134C, 134M, 134Y and 134K), that the ink viscosity measured by the viscometer 134K is higher than those measured by the viscometers 134C, 134M and 134Y.

Figure 6:
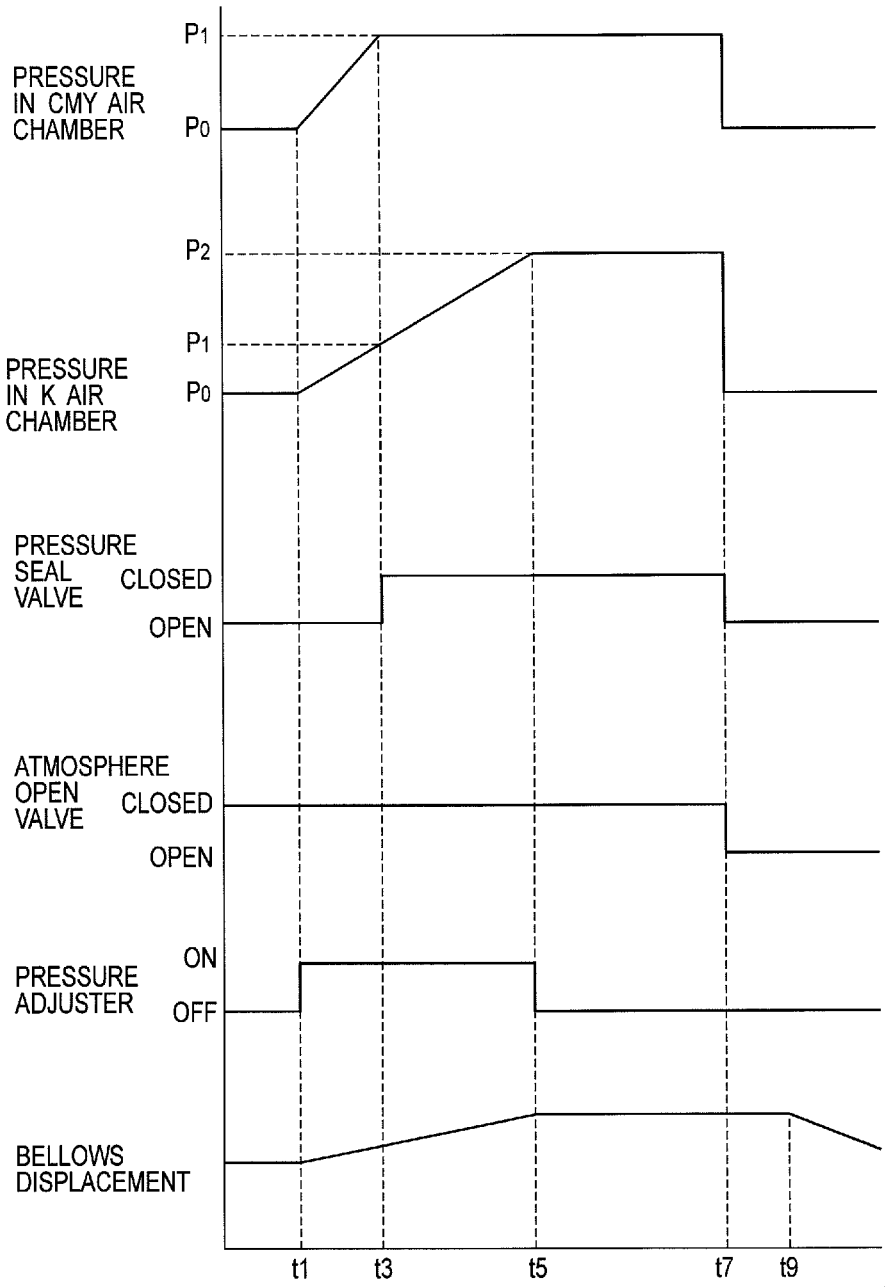
FIG. 6 is a timing chart showing a purge operation corresponding to the viscosity of the ink in the inkjet printer according to Embodiment 1 of the present invention.

FIG. 6 is a timing chart showing a purge operation corresponding to the ink viscosity in the inkjet printer 1 according to Embodiment 1.

As shown in FIG. 6, the pressure seal valve 106 is open and the atmosphere open valve 104 is closed at point t0.

Therefore, the CMY air chamber 101 and the K air chamber 103 communicate with each other. Also, the CMY air chamber 101 communicates with the downstream tanks 159C, 159M and 159Y, and the K air chamber 103 communicates with the downstream tank 159K.

Then, when the pressure adjuster 105 is turned on at point t1, the pressure adjuster 105 starts a purge operation so as to increase the pressure in the K air chamber 103. To be more specific, as displacement of the bellows elevating mechanism 105*a* increases, the bellows main body unit 105*b* is expanded and the pressures in the CMY air chamber 101 and the K air chamber 103 start to rise from P0.

Accordingly, the pressures of the air layers in the downstream tanks 159C, 159M and 159Y communicating with the CMY air chamber 101 rise. When the pressure in the CMY air chamber 101 reaches P1 at point t3, the controller 10 closes the pressure seal valve 106. Thus, the pressure in the CMY air chamber 101 remains constant at P1, and the level of liquid is lowered by the pressure P1 applied to the C (cyan), M (magenta) and Y (yellow) inks IK stored in the downstream tanks 159C, 159M and 159Y. Then, the inks IK are discharged by the ink amount D1 from the nozzles in the inkjet heads 110C, 110M and 110Y into the ink recovery chamber 124 by the applied pressure. Thus, nozzle clogging can be prevented by removing waste such as dried ink on the surfaces of the inkjet heads 110C, 110M and 110Y.

Meanwhile, since the pressure adjuster 105 stays ON even after the pressure seal valve 106 is closed at point t3, the pressure in the K air chamber 103 further rises. Accordingly, the pressure of the air layer in the downstream tank 159K communicating with the K air chamber 103 also rises.

Then, when the pressure in the K air chamber 103 reaches P2 at point t5, the level of liquid is lowered by the pressure applied to the black (K) ink IK stored in the downstream tank 159K. Then, the ink IK is discharged by the ink amount D1 from the nozzles in the inkjet head 110K into the ink recovery chamber 124 by the applied pressure. Thus, nozzle clogging can be prevented by removing waste such as dried ink on the surface of the inkjet head 110K. In this event, since the pressure seal valve 106 is closed, the purge operation is continued with the pressure in the CMY air chamber 101 staying the same at P1.

Thereafter, when the pressure seal valve 106 and the atmosphere open valve 104 are opened at point t7, the pressures in the CMY air chamber 101 and the K air chamber 103 become the atmospheric pressure, and the purge operation is completed.

As described above, in the inkjet printer 1 according to Embodiment 1, the controller 10 performs control such that the pressure adjuster 105 increases the pressures in the CMY air chamber 101 and the K air chamber 103 in the state where the pressure seal valve 106 is opened and the atmosphere open valve 104 is closed, and then the pressure adjuster 105 increases the pressure in the K air chamber 103 to the pressure P2 higher than the pressure P1 by closing the pressure seal valve 106. Thus, for the C (cyan), M (magenta) and Y (yellow) inks, the pressures in the downstream tanks 159 are increased to the pressure P1. Meanwhile, for the K (black) ink, the pressure in the downstream tank 159 is increased to the pressure P2. Accordingly, the purge operation can be performed by discharging all the C (cyan), M (magenta), Y (yellow) and K (black) inks by the same amount, i.e., the ink amount D1.

Note that, in Embodiment 1, the operation timing of the pressure seal valve 106, the atmosphere open valve 104 and the pressure adjuster 105 may be controlled based on the time elapsed since turning the pressure adjuster 105 on. Alternatively, the pressures in the CMY air chamber 101 and the K air chamber 103 may be measured, and the operation timing thereof may be controlled based on the measured pressure values.

Next, Embodiment 2 of the present invention is described. In Embodiment 1, the description is given by taking as an example the inkjet printer, which is the ink circulation type inkjet printer configured to circulate inks ejected from inkjet heads, and is configured to perform a purge operation of the inkjet heads by changing pressures in the downstream tanks according to the viscosity of the ink.

In Embodiment 2, description is given by taking as an example an inkjet printer, which is an ink circulation type inkjet printer configured to circulate inks ejected from inkjet heads, and is configured to perform a purge operation of the inkjet heads by changing time to maintain pressures in downstream tanks according to the viscosity of the ink.

Figure 7:
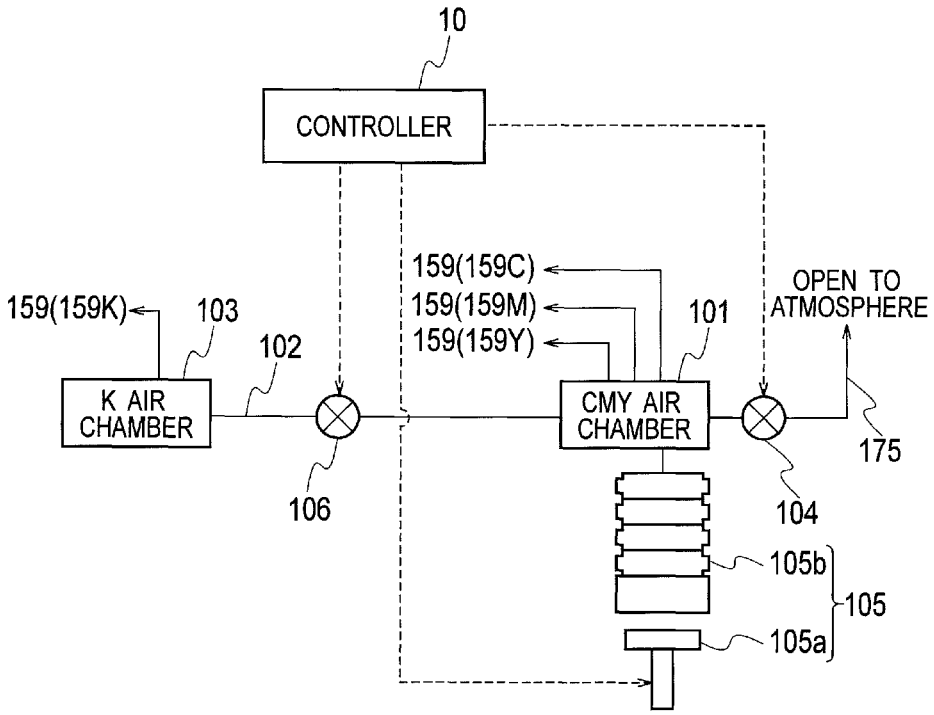
FIG. 7 is a functional block diagram showing a functional configuration of an inkjet printer according to Embodiment 2 of the present invention.

FIG. 7 is a functional block diagram showing a functional configuration of an inkjet printer 1 according to Embodiment 2.

As shown in FIG. 7, the inkjet printer 1 according to Embodiment 2 includes: a CMY air chamber 101 communicating with air layers in downstream tanks 159C, 159M and 159Y; and a K air chamber 103 communicating with an air layer in a downstream tank 159K. Also, a pressure seal valve 106 is provided in a communicating pipe 102 that communicates the CMY air chamber 101 with the K air chamber 103.

Moreover, the CMY air chamber 101 includes a pressure adjuster 105, and an atmosphere open valve 104 is provided in an atmosphere open pipe 175 connected thereto. Specifically, in the configuration of the inkjet printer 1 according to Embodiment 1, the K air chamber 103 corresponding to the K (black) ink having high ink viscosity is disposed on the atmosphere open side. Meanwhile, in the configuration of the inkjet printer 1 according to Embodiment 2, the CMY air chamber 101 corresponding to the C (cyan), M (magenta) and Y (yellow) inks having high ink viscosity is disposed on the atmosphere open side.

A The controller 10 in the inkjet printer 1 according to Embodiment 2 controls central processing such as print processing in the inkjet printer 1, and is electrically connected to the atmosphere open valve 104, the pressure adjuster 105 and the pressure seal valve 106 as shown in FIG. 7 for control thereof.

To be more specific, the controller 10 closes the pressure seal valve 106 based on the ink viscosities measured by the viscometers 134 (134C, 134M, 134Y and 134K) after allowing the pressure adjuster 105 to increase the pressures in the CMY air chamber 101 and the K air chamber 103 to the pressure P1 in the state where the pressure seal valve 106 is opened and the atmosphere open valve 104 is closed. Then, the controller 10 opens the atmosphere open valve 104 upon elapse of a first time after the pressures reaches the pressure P1, and opens the pressure seal valve 106 upon elapse of a second time that is longer than the first time after the pressures reaches the pressure P1.

Figure 8:
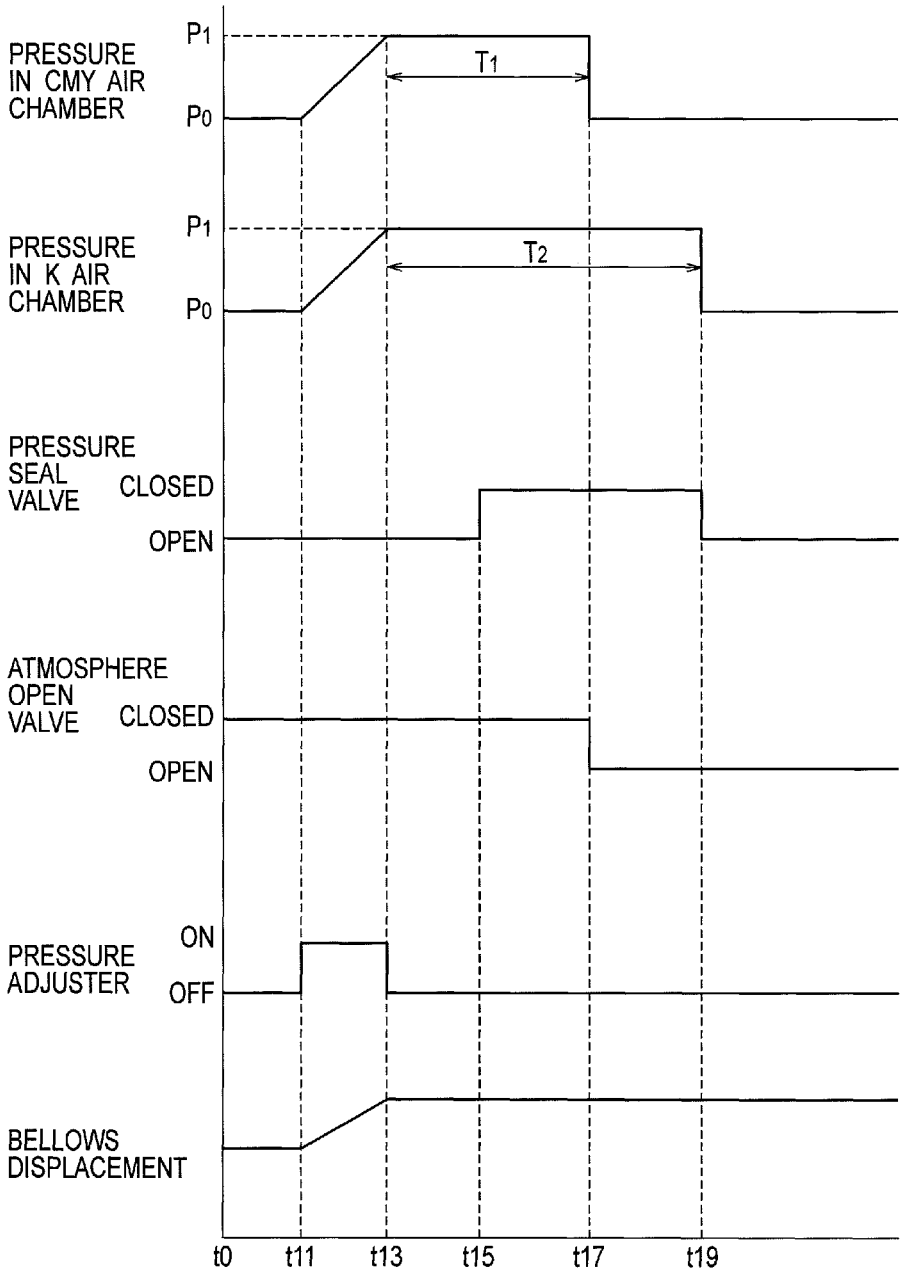
FIG. 8 is a timing chart showing a purge operation corresponding to the viscosity of ink in the inkjet printer according to Embodiment 2 of the present invention.

FIG. 8 is a timing chart showing a purge operation corresponding to the viscosity of the ink in the inkjet printer 1 according to Embodiment 2.

As shown in FIG. 8, the pressure seal valve 106 is open and the atmosphere open valve 104 is closed at point t0.

Therefore, the CMY air chamber 101 and the K air chamber 103 communicate with each other. Also, the CMY air chamber 101 communicates with the downstream tanks 159C, 159M and 159Y, and the K air chamber 103 communicates with the downstream tank 159K.

Then, when the pressure adjuster 105 is turned on at point t11, the pressure adjuster 105 starts a purge operation so as to increase the pressure in the CMY air chamber 101. To be more specific, as displacement of the bellows elevating mechanism 105*a* increases, the bellows main body unit 105*b* is expanded and the pressures in the CMY air chamber 101 and the K air chamber 103 start to rise from P0.

Accordingly, the pressures of the air layers in the downstream tanks 159C, 159M and 159Y communicating with the CMY air chamber 101 rise. When the pressure in the CMY air chamber 101 reaches P1 at point t13, the controller 10 closes the pressure seal valve 106. Thus, the pressure in the CMY air chamber 101 remains constant at P1, and the level of liquid is lowered by the pressure P1 applied to the C (cyan), M (magenta) and Y (yellow) inks IK stored in the downstream tanks 159C, 159M and 159Y, respectively.

Similarly, when the pressure seal valve 106 is closed at point t13, the pressure in the K air chamber 103 remains constant at P1, and the level of liquid is lowered by the pressure P1 applied to the K (black) ink IK stored in the downstream tank 159K.

Thereafter, after the pressure seal valve 106 is opened at point t15, the controller 10 opens the atmosphere open valve 104 at point t17 when a first time T1 has elapsed since point t13 when the pressures in the CMY air chamber 101 and the K air chamber 103 have reached the pressure P1. Thus, the CMY air chamber 101 and the K air chamber 103 are cut off, and only the CMY air chamber 101 is opened to the atmosphere. As a result, the pressure in the CMY air chamber 101 becomes the atmospheric pressure P0. Here, the first time T1 is set, according to the viscosities of the C (cyan), M (magenta) and Y (yellow) inks, as the time to discharge the inks by the ink amount D1 when the pressures in the downstream tanks 159C, 159M and 159Y are preset to P1.

As described above, since the pressure in the CMY air chamber 101 is maintained at P1 during the first time T1, a purge operation can be performed by discharging the inks IK from the nozzles in the inkjet heads 110C, 110M and 110Y by the ink amount D1 into the ink recovery chamber 124. Thus, nozzle clogging can be prevented by removing waste such as dried ink on the surfaces of the inkjet heads 110C, 110M and 110Y.

Subsequently, the controller 10 opens the pressure seal valve 106 at point t19 when a second time T2 has elapsed since point t13 when the pressures in the CMY air chamber 101 and the K air chamber 103 have reached the pressure P1. Thus, the CMY air chamber 101 and the K air chamber 103 are opened to the atmosphere and the pressures therein become the atmospheric pressure P0. Here, the second time T2 is set, according to the viscosity of the K (black) ink, as the time to discharge the ink by the ink amount D1 when the pressure in the downstream tank 159C, 159K is preset to P1.

As described above, since the pressure in the K air chamber 103 is maintained at P1 during the second time T2 longer than the first time T1, a purge operation can be performed by discharging the K (black) ink having high viscosity from the nozzles in the inkjet head 110K by the ink amount D1. Thus, nozzle clogging can be prevented by removing waste such as dried ink on the surface of the inkjet head 110K.

As described above, in the inkjet printer 1 according to Embodiment 2, the controller 10 performs control so as to close the pressure seal valve 106 based on the ink viscosities (viscosity information) measured by the viscometers 134 (134C, 134M, 134Y and 134K) after allowing the pressure adjuster 105 to increase the pressures in the CMY air chamber 101 and the K air chamber 103 to the pressure P1 in the state where the pressure seal valve 106 is opened and the atmosphere open valve 104 is closed. Then, the controller 10 opens the atmosphere open valve 104 upon elapse of the first time T1 after the pressure P1 is reached, and opens the pressure seal valve 106 upon elapse of the second time T2 longer than the first time after the pressure P1 is reached. Accordingly, the pressure P1 is applied to the C (cyan), M (magenta) and Y (yellow) inks in the downstream tanks 159 for the first time T1, while the pressure P2 is applied to the K (black) ink in the downstream tank 159 for the second time T2. Thus, the purge operation can be performed by discharging all the C (cyan), M (magenta), Y (yellow) and K (black) inks by the same amount, i.e., the ink amount D1. Note that, as in the case of Embodiment 1, the controller 10 may perform the above control only when it is determined, based on the ink viscosities (viscosity information) measured by the viscometers (viscosity information acquisition unit) 134 (134C, 134M, 134Y and 134K), that the ink viscosity measured by the viscometer 134K is higher than those measured by the viscometers 134C, 134M and 134Y.

Note that, in Embodiments 1 and 2, K (black) is set as the ink having high viscosity and C (cyan), M (magenta) and Y (yellow) are set as the inks having low viscosity. However, the present invention is not limited thereto. For example, assuming K (black), C (cyan), M (magenta) and Y (yellow) in descending order of viscosity, K (black) and C (cyan) may be set as the inks having high viscosity and M (magenta) and Y (yellow) may be set as the inks having low viscosity. Alternatively, K (black), C (cyan) and M (magenta) may be set as the inks having high viscosity and Y (yellow) may be set as the ink having low viscosity.

Moreover, in Embodiments 1 and 2, the ink viscosities measured by the viscometers 134 (134C, 134M, 134Y and 134K) are used as the viscosity information, and the controller 10 controls the opening and closing of the pressure seal valve 106 and the atmosphere open valve 104 based on the viscosity information. However, the viscosity information is not limited to the viscosities directly measured by the viscometers 134 (134C, 134M, 134Y and 134K). For example, using the relationship between the ink temperature and the ink viscosity shown in FIG. 5A, viscosities corresponding to the temperatures measured by the thermometers 135 (135C, 135M, 135Y and 135K) may be calculated, and the calculated viscosities may be used as the viscosity information. A unit configured to acquire the viscosity information is a viscosity information acquisition unit.

Furthermore, in Embodiments 1 and 2, the description is given by taking as an example the inkjet printer 1 including the multiple inkjet heads 110, the multiple downstream tanks 159 to recover the inks which are not ejected, the CMY ink air chamber 101 communicating with the air layer in the downstream tank 159 to recover the ink having the first viscosity, and the K ink air chamber 103 communicating with the air layer in the downstream tank 159 to recover the ink having the second viscosity higher than the first viscosity. However, the tanks communicating with the CMY ink air chamber 101 and the K ink air chamber 103 are not limited to the downstream tanks 159. For example, the inkjet printer 1 may include the multiple upstream tanks 153 to feed the inks to the multiple inkjet heads 110, a CMY ink air chamber communicating with the air layer in the upstream tank 153 to feed the ink having the first viscosity, and a K ink air chamber communicating with the air layer in the upstream tank 153 to feed the ink having the second viscosity higher than the first viscosity.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a first inkjet head configured to eject an ink having a first viscosity onto a print medium;

a second inkjet head configured to eject an ink having a second viscosity different from the first viscosity onto the print medium;

a first ink tank in communication with the first inkjet head and configured to store the ink having the first viscosity;

a second ink tank in communication with the second inkjet head and configured to store the ink having the second viscosity;

a first ink air chamber in communication with an air layer in the first ink tank;

a second ink air chamber in communication with an air layer in the second ink tank;

a communicating pipe through which the first ink air chamber and the second ink air chamber communicate with each other;

a first on-off valve provided in the communicating pipe and configured to open or close communication between the first ink air chamber and the second ink air chamber;

an atmosphere open pipe connected to the second ink air chamber and opened to the atmosphere;

a second on-off valve provided in the atmosphere open pipe and configured to open or close communication between the second ink air chamber and the atmosphere;

a pressure adjuster configured to adjust a pressure in the second ink air chamber without intervention of the first ink air chamber; and a controller configured to control the first on-off valve, the second on-off valve, and the pressure adjuster, and configured to drive the pressure adjuster to increase the pressure in the second ink air chamber with the first on-off valve and the second on-off valve being closed.

2. The inkjet printer according to claim 1, further comprising: a viscosity information acquisition unit configured to acquire viscosity information of the first viscosity and the second viscosity, wherein the controller is configured to drive the pressure adjuster to increase a pressure in the first ink air chamber and the pressure in the second ink air chamber to a first pressure required for a purge operation of the first inkjet head with the first on-off valve being opened and the second on-off valve being closed, and then control opening and closing of the first and second on-off valves such that purge operations of the first and second inkjet heads are performed based on the viscosity information acquired by the viscosity information acquisition unit.

3. The inkjet printer according to claim 1, further comprising: a viscosity information acquisition unit configured to acquire viscosity information of the first viscosity and the second viscosity, wherein when the controller determines based on the viscosity information acquired by the viscosity information acquisition unit that the second viscosity is higher than the first viscosity, the controller is configured to drive the pressure adjuster to increase a pressure in the first ink air chamber and the pressure in the second ink air chamber to a first pressure required for a purge operation of the first inkjet head with the first on-off valve being opened and the second on-off valve being closed, and then drive the first on-off valve to close and drive the pressure adjuster to increase the pressure in the second ink air chamber to a second pressure higher than the first pressure.

4. The inkjet printer according to claim 1, further comprising: a viscosity information acquisition unit configured to acquire viscosity information of the first viscosity and the second viscosity, wherein when the controller determines based on the viscosity information acquired by the viscosity information acquisition unit that the first viscosity is higher than the second viscosity, the controller is configured to drive the pressure adjuster to increase a pressure in the first ink air chamber and the pressure in the second ink air chamber to a first pressure required for a purge operation of the first inkjet head with the first on-off valve being opened and the second on-off valve being closed, and then drive the first on-off valve to close, drive the second on-off valve to open upon elapse of a first time after the pressures reach the first pressure, and drive the first on-off valve to open upon elapse of a second time longer than the first time after the pressures reach the first pressure.

* * * * *